US005266448A

United States Patent [19]

Shuto et al.

[11] Patent Number: 5,266,448

[45] Date of Patent: Nov. 30, 1993

[54] METHOD OF PROCESSING SILVER HALIDE COLOR PHOTOGRAPHIC MATERIALS

[75] Inventors: Sadanobu Shuto; Takatoshi Ishikawa, both of Kanagawa, Japan

[73] Assignee: Fuji Photo Film Co., Ltd., Kanagawa, Japan

[21] Appl. No.: 858,658

[22] Filed: Mar. 27, 1992

[30] Foreign Application Priority Data

Mar. 27, 1991 [JP] Japan ..... 3-85797

[51] Int. Cl.[5] ..... G03C 7/46

[52] U.S. Cl. ..... 430/379; 430/407; 430/547; 430/589; 430/940

[58] Field of Search ..... 430/378, 379, 406, 407, 430/547, 589, 940

[56] References Cited

U.S. PATENT DOCUMENTS 4,554,245 11/1985 Hayashi et al. ..... 430/407
4,717,648 1/1988 Ueda et al. ..... 430/489
4,865,963 9/1989 Furutachi et al. ..... 430/558

*Primary Examiner*—Hoa Van Le
*Attorney, Agent, or Firm*—Sughrue, Mion, Zinn, Macpeak & Seas

[57] ABSTRACT

A method for color reversal processing of an imagewise exposed silver halide color photographic material comprising first developing in a black-and-white developing bath, next color developing in a color developing bath, and then desilvering in a bath having a bleaching ability. The black-and-white developing bath has a bromide concentration in the range of 0.025 to 0.1 mol/l and is used for the black-and-white development. Furthermore, in a preferred embodiment, the photographic material comprises at least one silver halide emulsion layer containing a silver halide emulsion comprising silver halide grains having an average grain size of 0.3 μm or less. In accordance with the invention, the maximum densities of the developed color images are increased without lowering of the sensitivity and contrast.

11 Claims, 1 Drawing Sheet

METHOD OF PROCESSING SILVER HALIDE COLOR PHOTOGRAPHIC MATERIALS

FIELD OF THE INVENTION

The present invention relates to a method of processing a silver halide color photographic material using a color reversal process and, more particularly, to a color reversal processing method which provides color images having high maximum density and excellent photographic quality.

BACKGROUND OF THE INVENTION

In a reversal process for a color reversal silver halide photographic material such as a color reversal paper, an imagewise exposed color photographic material is generally subjected first to development, then reversal, next to color development and bleach-fixing steps which are performed in that order. The first development is also called black-and-white development, wherein silver halide emulsion grains exposed to an imagewise pattern of light are developed with a black-and-white developer. In a reversal step subsequent thereto, silver halide emulsion grains present in the unexposed areas are optically fogged or treated with a fogging agent. Then, the silver halide emulsion grains which have undergone the reversal processing are subjected to color development to form an image. Desilvering is then carried out using a bleach-fix bath in the bleach-fixing step.

The above-described combination of processing steps is basic, such that a washing, a stabilization and/or other steps may be provided between or after the basic steps, as needed. For example, a process for processing a color reversal paper may consist of a series of steps as described below:

Black-and-white development-Stop-Washing-Reversal exposure-Color development-Washing-Bleach-fix-Washing-Stabilization-Rinsing-Drying.

The details of a series of steps constituting a color reversal process vary depending on the content of the silver halide photographic material to be processed. For example, the details of a suitable color reversal process are appreciably different between a photographic material containing color image forming couplers (e.g., a coupler-in-emulsion type color photographic material), and a photographic material in which the color image forming couplers are supplied from a processing solution at the time of development, but are not incorporated into the photographic material itself (e.g., a coupler-in-developer type color photographic material). In both cases, however, the first development step is carried out as an initial stage of the process.

A typical composition of a black-and-white developer for use in this first development step includes 3-pyrazolidones or hydroquinones as a developing agent and sulfites or hydrogen sulfites as a preservative, while optional components include carbonates as an alkali agent, thioether compounds as an accelerator, potassium bromide as an antifoggant, etc. With regard to potassium bromide in particular, three compounding examples are known as disclosed in U.S. Pat. No. 4,865,963, wherein the potassium bromide concentrations are 0.5 g/l, 1 g/l and 2.5 g/l at the most, respectively.

In a color reversal process, as described above, the first black-and-white development is carried out as a first processing stage. Therefore, it is considered that the contents of the first development have a great influence upon the results of subsequent steps. In other words, the quality of an image formed, or the quality of the photographic properties obtained, depends on the result of the first development.

SUMMARY OF THE INVENTION

A first object of the present invention is to provide a processing method for color reversal processing of a silver halide color photographic material employing a black-and-white developer in the invention for the black-and-white development which imparts high maximum developed-color image density and excellent photographic characteristics to the photographic materials processed.

A second object of the present invention is to provide a processing method for color reversal processing which prevents a decrease in photographic speed and contrast and other side effects, and which ensures desirable photographic properties as a whole for the photographic material when black-and-white development is carried out using the above-described black-and-white developer.

As a result of studying color reversal processes in which black-and-white development was performed using various black-and-white developers differing in composition, the present inventors have discovered that satisfactory photographic properties including high maximum density of the developed color image are obtained by using a black-and-white developing bath containing bromide ion in a specified concentration range in the black-and-white development of a silver halide color photographic material, thus achieving the present invention.

Namely, the present invention comprises color reversal processing of an imagewise exposed silver halide color photographic material comprising a support having thereon at least one red-, at least one green- and at least one blue-sensitive silver halide emulsion layer, comprising the steps of first developing in a black-and-white developing bath containing bromide ion in a concentration of from 0.025 to 0.1 mol/l, next color developing in a color developing bath, and then desilvering in a bath having a bleaching ability.

Although there is a tendency for color reversal processing with a black-and-white developing bath having the above-defined bromide concentration to result in lower photographic speed and contrast, the present inventors have also discovered that this tendency can be avoided by the use of a silver halide color photographic material comprising at least one silver halide emulsion layer containing silver halide emulsion grains having an average grain size of 0.3 μm or less in the color reversal process.

DETAILED DESCRIPTION OF THE INVENTION

Figure 1:
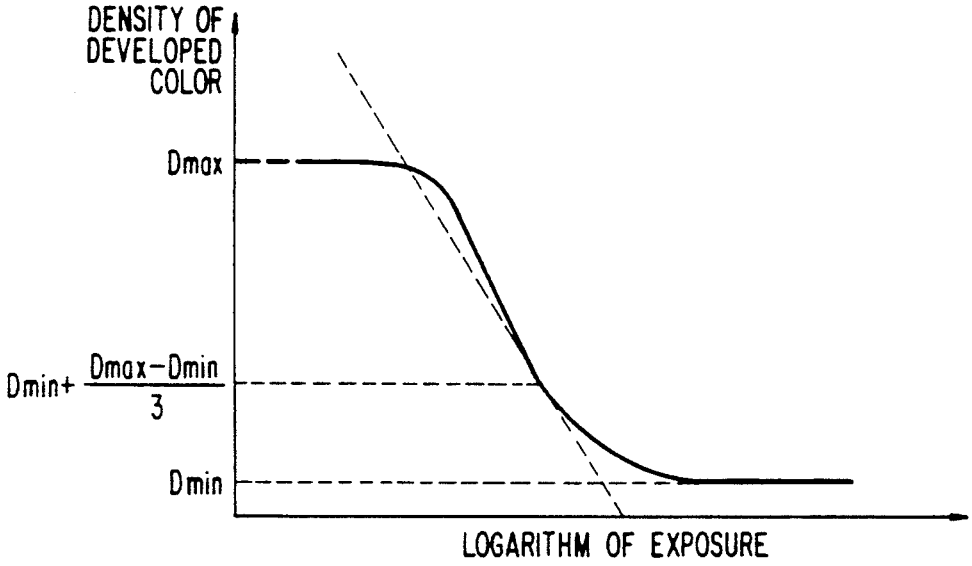
FIG. 1 shows a characteristic curve obtained from density measurements of a development-processed photographic material.

Useful bromides for addition to the black-and-white developing bath of the present invention include potassium bromide and sodium bromide, and the bromide concentration of the black-and-white developing bath is from 0.025 to 0.1 mol/l, and preferably from 0.03 to 0.08 mol/l.

As long as the above described bromide concentration of the black-and-white developing bath is met at the time of processing, the effects of the present invention can be achieved. The bromide concentration may be adjusted by controlling the amount and composition of the replenisher added to the black-and-white developing bath. Furthermore, processing within the above-described bromide concentration range allows for reduction in the replenishment amount of the black-and-white developing bath.

Conventional processing steps can be applied to the color reversal process of the present invention, with the exception of the bromide concentration of the black-and-white developing bath.

The processing steps relating to the color reversal process of the present invention are described below in detail.

In the black-and-white developer for use in the present invention, known black-and-white developing agents, such as dihydroxybenzenes (e.g., hydroquinone, hydroquinone monosulfonate), 3-pyrazolidones (e.g., 1-phenyl-3-pyrazolidone, 1-phenyl-4-methyl-4-hydroxymethyl-3-pyrazolidone), aminophenols (e.g., N-methyl-p-aminophenol), ascorbic acid, and the heterocyclic compounds disclosed in U.S. Pat. No. 4,067,872, namely those formed by condensation of 1,2,3,4-tetrahydroquinoline and indolene rings, can be used alone or in combination. The addition amount of the developing agent ranges from about $1\times10^{-5}$ mol/l to about 1 mol/l.

The black-and-white developer for use in the present invention can optionally contain preservatives (e.g., sulfites, hydrogen sulfites), buffers (e.g., carbonates, boric acid, borates, alkanolamines), alkali agents (e.g., hydroxides, carbonates), dissolution aids (e.g., polyethylene glycols and their esters), pH adjusters (e.g., organic acids such as acetic acid), sensitizers (e.g., quaternary ammonium salts), development accelerators, surfactants, defoaming agents, hardeners, viscosity conferring agents, etc.

The black-and-white developer for use in the present invention preferably contains a silver halide solvent. In general, the above-cited sulfites, which can be added as a preservative, can also function as a silver halide solvent. Examples of the sulfites and other useful silver halide solvents include KSCN, NaSCN, $K_2SO_3$, $Na_2SO_3$, $K_2S_2O_5$, $Na_2S_2O_3$, $K_2S_2O_3$, $Na_2S_2O_3$, 2-methylimidazole, etc.

When the addition amount of the silver halide solvent is too low, the development proceeds slowly, whereas an addition amount that is too large amount results in generation of fog in the silver halide emulsion layers. A desirable addition amount of the silver halide solvent can be determined with ease by one skilled in the art.

For example, a desirable concentration of SCN ranges from 0.005 to 0.02 mole, preferably from 0.01 to 0.015 mole, per l of developer, while that of $SO_3^{-2}$ ranges from 0.05 to 1 mole, preferably from 0.1 to 0.5 mole, per l of developer.

Examples of the development accelerator used for conferring a development accelerating effect upon the developer preferably include the thioether compounds disclosed in JP-A-57-63580 (The term "JP-A" as used herein means an "unexamined published Japanese patent application"). Among the thioether compounds, $HOCH_2CH_2SCH_2CH_2CH_2CH_2OH$ and $HOCH_2CH(OH)CH_2SCH_2CH_2SCH_2CH(OH)CH_2OH$ are especially preferred.

When used, the above described thioether compounds are added to the black-and-white developer of this invention in a concentration ranging from $5\times10^{-6}$ to $5\times10^{-1}$ mole, particularly from $1\times10^{-4}$ to $2\times10^{-1}$ mole, per l of the developer.

For the prevention of developer fog in the black-and-white developing step, various kinds of antifoggants may be added to the black-and-white developer of this invention. Useful antifoggants include not only the bromides of the present invention, but also alkali halides such as potassium iodide and organic antifoggants as examples. Specific examples of organic antifoggants which can be used effectively include nitrogen containing heterocyclic compounds such as benzotriazole, 6-nitrobenzimidazole, 5-nitroindazole, 5-methylbenzotriazole, 5-nitrobenzotriazole, 5-chlorobenzotriazole, 2-thiazolyl-benzotriazole, 2-thiazolylmethylbenzimidazole, hydroxyazaindolidine, etc., mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thiosalicylic acid, etc. The above described antifoggants include those eluted from color reversal photographic materials to accumulate in the developer.

Among the above-noted antifoggants, iodides are used in a concentration ranging from $1\times10^{-6}$ to $1\times10^{-2}$ mole/l, preferably from $1\times10^{-5}$ to $1\times10^{-3}$ mole/l.

Furthermore, swelling inhibitors (e.g., inorganic salts such as sodium sulfate, potassium sulfates and the like) and water softeners can be added to the black-and-white developer of the present invention.

Water softeners which can be added to the black-and-white developer of this invention are various types such as aminopolycarboxylic acids, aminopolyphosphonic acids, phosphonocarboxylic acid, organic and inorganic phosphoric acids. Specific examples thereof are given below. However, the present invention should not be construed as being limited to these examples.

Ethylenediaminetetraacetic acid,
Hydroxyethyliminodiacetic acid,
Propylenediaminetetraacetic acid,
Diethylenetriaminepentaacetic acid,
Triethylenetetraminehexaacetic acid,
Nitro-N,N,N-trimethylenephosphonic acid,
Ethylenediamine-N,N,N,,N,-tetramethylenephosphonic acid,
1-Hydroxyethylidene-1,1-diphosphonic acid.

These water softeners may be used as a mixture of two or more kinds thereof, and are preferably added in a concentration ranging from 0.1 to 20 g/l, particularly from 0.5 to 10 g/l.

The pH of the thus prepared black-and-white developer, adjusted as required for achieving the desired density and contrast, is within the range of from about 8.5 to about 11.5.

The processing time for the black-and-white development ranges from 20 seconds to 3 minutes, preferably from 30 seconds to 2 minutes. When the processing time is over 3 minutes, it is not acceptable according to the present invention due to lowering Dmax. The processing temperature therefor ranges from 30° C. to 50° C., preferably from 35° C. to 45° C. An amount of a replenisher added to the black-and-white developer of this invention ranges from 30 to 500 ml, preferably from 50 to 250 ml, per $m^2$ of photographic material processed.

In the color reversal process of the present invention, the photographic material is subjected to washing and/or rinsing processing subsequent to the black-and-white development. Thereafter, the photographic material is processed with a reversal bath (fogging bath), if needed, and then subjected to color development.

Although a washing or rinsing bath may be a single stage bath, for reduction in replenishment a multistage counter current process using two or more processing tanks is preferably used. The term "washing" means replenishing the bath with a relatively large amount of water, while the term "rinsing" means reducing the amount of water for replenishment to a level about equal to those of other processing baths in the processing sequence. The amount of water for replenishing the washing bath ranges from about 3 to 20 liter per $m^2$ of photographic material processed. On the other hand, the amount of replenisher for the rinsing bath ranges from about 50 ml to 2 liter, preferably from 100 ml to 500 ml, per $m^2$ of photographic material. That is, the amount of water for replenishment used for the rinsing bath is greatly reduced, compared with that for the washing bath.

The pH of the rinsing bath for use in the present invention is generally adjusted to 9.5 or lower. When the processing bath subsequent to the rinsing bath is a color developing bath, the rinsing bath is preferably a buffer solution having its pH within the range of 5.0 to 9.5 to prevent a reduction in color developing capacity. More preferably, the rinsing bath is designed so that the pH thereof may be maintained by the addition of pH buffers within the range of 6.0 to 9.0, particularly 7.0 to 8.0, during the continuous operation of a processing machine. Furthermore, the difference in pH of the buffer solution prior to and following the continuous processing is desirably controlled within the range of $-1.2$ to $+1.2$ pH units.

Moreover, the rinsing bath for use in the present invention preferably contains as an oxidizing agent at least one compound selected from peroxides and halates. Useful examples of such compounds include hydrogen peroxide, persulfates, perchlorates, hypochlorites, chlorites, chlorates, alkylhydroperoxides, peroxy acids, peroxy acid esters, alkylperoxides, acylperoxides and other organic peroxides. Among these compounds, those which yield colorless and harmless compounds upon decomposition, particularly inorganic reaction products, are preferred. Base components of the above-cited inorganic compounds are preferably alkali metals, alkaline earth metals and ammonium, particularly preferably sodium and potassium.

The amount of the oxidizing agent added to the rinsing bath ranges preferably from $1\times10^{-5}$ to $5\times10^{-2}$ mole, particularly from $1\times10^{-4}$ to $1\times10^{-2}$ mole, per liter of the rinsing solution. When the addition amount of the oxidizing agent is too low, some of the black-and-white developing agent which is carried over into the rinsing bath from the prebath is not completely decomposed in the rinsing bath, to thereby result in fogging. On the other hand, when the addition amount of the oxidizing agent is too high, some of the oxidizing agent is carried over to the succeeding bath to adversely affect the solution stability of the succeeding bath (e.g., reversal bath or color developing bath).

The rinsing bath subsequent to the black-and-white developing bath of the present invention can contain various compounds for pH adjustment. Examples of such compounds include pH buffers such as phthalates, phosphates, citrates, succinates, tetraborates, borates, tartarates, lactates, carbonates, propionates, isopropionates, butyrates, isobutyrates, glycine salts, dimethylglycine salts, diethylbarbiturates, 2,4,6-trismethylpyridine salts, tris(hydroxymethyl)aminomethane salts, 2-amino-2-methyl-1,3-propanediol salts, ammonium salts, etc.

The amount of buffer added to the rinsing bath which follows the black-and-white processing of the present invention can be in any range as long as the desired buffering effect is obtained, and preferably ranges from $1.0\times10^{-5}$ to 1.0 mole, more preferably from $1\times10^{-4}$ to $5\times10^{-4}$ mole, per liter of the rinsing bath.

It is especially desirable that the rinsing bath further contain as chelating agents the organic phosphonic acid compounds and aminophosphonic acid compounds as disclosed in *Research Disclosure,* No. 18170 (May, 1979), JP-A-52-102726, JP-A-53-42730, JP-A-54-121127, JP-A-55-4024, JP-A-55-4025, JP-A-55-126241, JP-A-55-65955, JP-A-55-65956, and so on.

An appropriate amount of the above-noted organic phosphonic acid compounds for addition to the rinsing bath ranges from $1.0\times10^{-4}$ to $1\times10^{-1}$ mole, preferably $5\times10^{-4}$ to $5\times10^{-2}$ mole, per liter of the rinsing bath. The above described organic phosphonic acid compounds may be added to the rinsing bath individually or in combination thereof.

In addition, to prevent metal ions such as calcium, magnesium and iron ions from precipitating, the rinsing bath preferably contains various kinds of chelating compounds (e.g., polyphosphoric acid compounds such as sodium tetrapolyphosphate, etc., aminocarboxylic acids such as ethylenediaminetetraacetic acid, diethylenetriaminetetraacetic acid, nitrilotriacetic acid, 1,2-cyclohexanediaminetetraacetic acid, etc., salicylic acid derivatives such as salicylic acid, 5-sulfosalicylic acid, etc., the chelating compounds disclosed in U.S. Pat. No. 4,482,626, and the chelating compounds disclosed in JP-A-58-203440). These chelating compounds may be added to the rinsing bath individually or as a mixture of two or more thereof, or in combination with the above-described organic phosphonic acid compounds.

An amount of these chelating compounds for preventing the precipitation of metal ions for addition to the rinsing bath ranges from $1\times10^{-4}$ to $1\times10^{-1}$ mole, particularly from $5\times10^{-4}$ to $5\times10^{-2}$ mole, per liter of the rinsing bath.

In the rinsing bath following the black-and-white developing step of the present invention, various kinds of microbes tend to proliferate when the pH of the bath is close to neutral, to thereby generate precipitates or suspended matter. In order to prevent the proliferation of microbes, one or more compounds known as antibacterial agents, antiwaterweeds and antimolds are preferably added. For example, the compounds described in *Journal of Antibacterial and Antifungal agents,* vol. 11, No. 5, pp. 207-223 (1982), the compounds described in Hiroshi Horiguchi, *Bohkin Bohbai no Kagaku,* published by Sankyo Shuppan (1982), metal salts representative examples of which include magnesium salts and aluminum salts, alkali metal and ammonium salts, or surfactants are optionally added. On the other hand, the compounds described in West, *Photographic Science and Engineerings,* vol.6, pp. 344-359 (1965), etc., can also be added to the rinsing solution. In particular, the addition of chelating agents, bactericides and antimolds to the rinsing solution is effective.

Suitable examples of bactericides and antimolds include thiazoles, isothiazoles, halogenated phenols, sulfanylamides, benzotriazoles, etc.

The rinsing bath for use in the present invention can further contain a brightening agent in order to heighten the whiteness of the processed color photographic material. For this purpose, brightening agents of the stilbene type are effectively used.

The fogging bath for use in the present invention can contain known fogging agents in an amount of from 1 mg/l to 10 g/l. Specific examples of useful fogging agents include stannous ion complexes, such as stannous ionorganic phosphoric acid complexes (disclosed in U.S. Pat. No. 3,617,282), stannous ion-organic phosphonocarboxylic acid complexes (disclosed in JP-B-56-32616), stannous ion-aminopolycarboxylic acid complexes (disclosed in British Patent 1,209,050), etc.; and boron compounds, such as borohydride compounds (disclosed in U.S. Pat. No. 2,984,567), heterocyclic aminoboran compounds (disclosed in British Patent 1,011,000), etc. The term "JP-B" as used therein means an "examined Japanese patent publication". The pH of the fogging bath (reversal bath) covers a wide range, from acidic to alkaline. Generally, the pH of the fogging bath is from 2 to 12, preferably from 2.5 to 10, and more preferably from 3 to 9. A time for treatment in fogging bath are 5 seconds to 5 minutes at a temperature of from 25° C. to 45° C. An amount of replenisher for the fogging bath is from 30 to 600 cc/m$^2$ photosensitive material. The reversal processing may be carried out using a fogging bath or re-exposure means. On the other hand, the reversal step may be omitted by incorporating a fogging agent into the color developing bath.

The color developing solution for use in the present invention is preferably an alkaline aqueous solution containing as a main component an aromatic primary amine type color developing agent. Preferred color developing agents are p-phenylenediamine compounds. Representative examples of p-phenylenediamine compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides, phosphates or p-toluenesulfonates of the above-cited anilines.

The concentration of the color developing agent and the pH of the color developing bath are important for reducing the color developing time. The developing time for color development is from 2 seconds to 6 minutes, preferably from 30 seconds to 120 seconds. In the present invention, the color developing agent is contained in the color developing solution in a concentration ranging from about 1.0 to about 15 g/l, more preferably from about 3.0 to about 8.0 g/l. The pH of a color developing bath is adjusted generally to 8 or above, most preferably within the range of about 8 to about 13.

The processing temperature of the color developing bath for use in the present invention is preferably in the range of 20° C. to 70° C., more preferably 30° C. to 60° C. and the most preferably 35° C. to 45° C.

A wide variety of development accelerators may be used in the present invention depending on the particular application.

Specific examples of development accelerators for use in the present invention include benzyl alcohol; various kinds of pyridinium compounds and other cationic compounds as disclosed in U.S. Pat. No. 2,648,604, JP-B-44-9503 and U.S. Pat. No. 3,171,247; cationic dyes such as phenosafranine; neutral salts such as thallium nitrate and potassium nitrate; nonionic compounds including polyethylene glycol and derivatives thereof, polythioethers and the like, as disclosed in JP-B-44-9304 and U.S. Pat. Nos. 2,533,990, 2,531,832, 2,950,970 and 2,577,127; and thio-ether compounds disclosed in U.S. Pat. No. 3,201,242.

In particular, the addition of benzyl alcohol and thioether compounds to the color developing solution is effective. Benzyl alcohol can be added in the range of 2 ml to 30 ml, preferably 5 ml to 20 ml, per liter of the color developing solution. As for the thioether compounds, those described above as being suitable for the black-and-white developer are also effective in the color developer. The thioether compounds are added in a concentration ranging from 0.01/l to 10 g/l, preferably from 0.1 g/l to 5 g/l of the color developing solution.

To prevent developer fog in the color developing step, various kinds of antifoggants may be added to the color developing solution. Effective antifoggants include alkali halides such as potassium bromide, sodium bromide, potassium iodide, etc., and organic antifoggants. Specific examples of effective organic antifoggants include nitrogen containing heterocyclic compounds such as benzotriazole, 6-nitrobenzimidazole, 5-nitroindazole,5-methylbenzotriazole, 5-nitrobenzotriazole, 5-chlorobenzotriazole, 2-thiazolyl-benzotriazole, 2-thiazolylmethylbenzimidazole, hydroxyazaindolidine, etc., mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thio-salicylic acid, etc. These antifoggants include those eluted from the processed color photographic material which accumulate in the developer.

Among the above-noted antifoggants, bromides are preferably used. A suitable bromide concentration ranges from $1\times10^{-3}$ to 0.1 mole/l, particularly from $2\times10^{-3}$ to $2\times10^{-2}$ mole/l of the color developer solution. Furthermore, iodides may be used, if desired. A suitable iodide concentration ranges from $1\times10^{-6}$ to $1\times10^{-2}$ mole/l, preferably from $1\times10^{-5}$ to $1\times10^{-3}$ mole/l of the color developing solution.

In addition to the above-described additives, the color developing solution can contain pH buffering agents such as carbonates, borates or phosphates of alkali metals; preservatives such as hydroxylamine, diethylhydroxylamine, triethanolamine, catechol-3,5-disulfonates, the compounds disclosed in West German Patent Application (OLS) No. 2,622,950, sulfites, hydrogen sulfites, etc.; organic solvents such as diethylene glycol, triethylene glycol, etc.; dye forming couplers; competing couplers such as citrazinic acid, J-acid, H-acid, etc.; nucleating agents such as sodium borohydride, etc.; auxiliary developing agents such as 1-phenyl-3-pyrazolidones, etc.; viscosity conferring agents; and chelating agents such as aminopolycarboxylic acids represented by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid and the compounds disclosed in JP-A-58-195845, aminophosphonic acids including 1-hydroxyethylidene-1,1'-diphosphonic acid, the organic phosphonic acids described in Research Disclosure, No. 18170 (May, 1979), aminotris-(methylenephosphonic acid) and ethylenediamine-N,N,N,,N,-tetramethylenephosphonic acid, and phosphonocarboxylic acids disclosed in JP-A-52-102726, JP-A-53-42730, JP-A-54-121127, JP-A-55-4024, JP-A-55-4025, JP-A-55-126241, JP-A-55-65955, JP-A-55-65956 and Research Disclosure, No. 18170 (May, 1979).

A reduction in the development time and amount of replenisher may be effected by dividing the color developing bath into two or more baths as required, and then replenishing the plural baths in cascade by adding a replenisher for the color developer to either the first or the last bath of the color developing sequence.

The pH of these baths preferably ranges from about 8 to 13, and the temperature thereof is selected from the range of 20° C. to 70° C., preferably 30° C. to 60° C., more preferably 35° C. to 45° C. The amount of the replenisher is in the range of 50 ml to 1,000 ml, preferably 100 ml to 500 ml, per $m^2$ of photographic material processed in the color developing bath.

After color development, the color photographic material is subjected to desilvering processing. The desilvering processing is generally a combination of steps as described below.

1. [color development]- compensation - bleaching - fixation
2. [color development]- washing - bleaching - fixation
3. [color development]- bleaching - fixation
4. [color development]- compensation - bleaching - washing - fixation
5. [color development]- washing bleaching - washing - fixation
6. [color development]- bleaching - washing - fixation
7. [color development]- washing - blix (or bleach-fix)
8. [color development]- compensation - blix
9. [color development]- blix
10. [color development]- washing - bleaching - blix
11. [color development]- compensation - bleaching - blix
12. [color development]- bleaching - blix
13. [color development]- washing - bleaching - blix - fixation
14. [color development]- compensation - bleaching - blix - fixation
15. [color development]- bleaching - blix - fixation Replenishment in the above-cited processing processes may be performed in a conventional manner, namely by replenishing the processing baths with their respective replenishers. In the processes from 10 to 12, however, replenishment may be accomplished in such a manner that the solution overflowing from the bleaching bath is introduced into the bleach-fix bath, and the bleach-fix bath is replenished with a fixing composition alone. In the processes from 13 to 15, on the other hand, replenishment may be accomplished in such a manner that the solution overflowing from the bleaching bath is introduced into the bleach-fix bath, a solution overflowing from the fixing bath is also introduced into the bleach-fix bath in a counter-current method, and the resulting solution is allowed to overflow from the bleach-fix bath.

Examples of the bleaching agent for use in the bleaching bath or the bleach-fix bath of the present invention include compounds of polyvalent transition metals such as Fe(III), Co(IV), Cr(VI), Mn(VII), Co(II), etc.; peroxy acids; quinones; etc. More specifically, ferricyanides, bichromates, organic acid chelates of Fe(III) or Co(VI), ferric chloride, persulfates, hydrogen peroxide, permanganates, and benzoquinone can be used. Among these compounds, those most commonly used are aminopolycarboxylic acid-Fe(III) complex salts. Representative examples of such aminopolycarboxylic acids and salts thereof are described below.

A-1 ethylenediaminetetraacetic acid,
A-2 disodium ethylenediaminetetraacetate
A-3 diammonium ethylenediaminetetraacetate
A-4 tetra(trimethylammonium) ethylenediaminetetraacetate
A-5 tetrapotassium ethylenediaminetetraacetate
A-6 tetrasodium ethylenediaminetetraacetate
A-7 trisodium ethylenediaminetetraacetate
A-8 diethylenetriaminepentaacetic acid
A-9 pentasodium diethylenetriaminepentaacetate
A-10 ethylenediamine-N-(β-oxyethyl)-N,N',N'-triacetic acid
A-11 trisodium ethylenediamine-N-(β-oxyethyl)-N,N',N'-triacetate
A-12 triammonium ethylenediamine-N-(β-oxyethyl)-N,N', N'-triacetate
A-13 propylenediaminetetraacetate
A-14 disodium propylenediaminetetraacetate
A-15 nitrilotriacetic acid
A-16 trisodium nitrilotriacetate
A-17 cyclohexanediaminetetraacetic acid
A-18 disodium cyclohexanediaminetetraacetate
A-19 iminodiacetic acid
A-20 dihydroxyethylglycine
A-21 ethyletherdiaminetetraacetic acid
A-22 glycoletherdiaminetetraacetic acid
A-23 ethylenediaminetetrapropionic acid
A-24 1,3-diaminopropanetetraacetic acid Aminopolycarboxylic acids for use as a bleaching agent in the present invention should not be construed as being limited to the above noted examples.

Among the above-noted compounds, A-1, A-2, A-3, A-8, A-17, A-18, A-19 and A-24 are preferred in particular.

The aminopolycarboxylic acid-Fe(III) complex salt may be directly added in the form of a previously prepared complex salt, or may be formed in the processing solution by mixing therein a ferric salt, such as ferric sulfate, ferric chloride, ferric nitrate, ammonium ferric sulfate, ferric phosphate, etc., with an aminopolycarboxylic acid. In the case where a complex salt is directly added in the form of complex salt, only one kind or no less than two kinds of such complex salts may be used. In the case where a complex salt is formed in the processing solution, only one kind or two or more kinds of ferric salts may be used. Therein, aminopolycarboxylic acids also may be used alone or as a mixture of two or more kinds thereof. In any case, the aminopolycarboxylic acid may be used in excess of the amount required stoichiometrically for the formation of the ferric ion complex.

In the bleaching or bleach-fix bath containing one or more ferric ion complexes as described above, other complex salts of metals including cobalt, copper and the like may be added thereto.

The bleaching bath, the bleach-fix bath or the compensating bath as a prebath thereof for use in the present invention can contain various kinds of bleaching and/or fixing accelerators.

Specific examples of useful bleach accelerators include mercapto group-containing compounds as disclosed in U.S. Pat. No. 3,893,858, British Patent 1,138,842 and JP-A-53-141623, disulfide linkage-containing compounds as disclosed in JP-A-53-95630, thiazolidine derivatives disclosed in JP-B-53-9854, isothiourea derivatives as disclosed in JP-B-53-94927, thiourea derivatives as disclosed in JP-B-45-8506 and JP-B-49-26586, thioamide compounds as disclosed in JP-A-49-42349, and dithiocarbamates as disclosed in JP-A-55-26506. Furthermore, unsubstituted alkylmercapto compounds or those substituted by a hydroxyl group, carboxyl group, sulfo group or an amino group (at any position of their alkyl or acetoxyalkyl moiety) can be used as the bleaching accelerator. Specific examples of such compounds include trithioglycerin, $\alpha,\alpha'$-thiodipropionic acid, $\delta$-mercaptobutyric acid, etc. Also, the compounds disclosed in U.S. Pat. No. 4,553,834 can be used.

A suitable concentration of the above described mercapto group- or disulfide linkage-containing compounds, thiazolidine derivatives or isothiourea derivatives in the bleaching bath for use as a bleaching accelerator in the present invention depends on the kind of photographic material to be processed, processing temperature and processing time. Generally, the concentration of the bleaching accelerator ranges from $1\times10^{-5}$ to $10^{-1}$ mol/l, particularly from $1\times10^{-4}$ to $5\times10^{-2}$ mol/l of the bleaching solution.

The above-described additives to the bleaching bath are generally dissolved in advance in water, an alkali, an organic acid, an organic solvent, etc. However, the additives may be added directly to the bleaching bath in the form of a powder since the bleach accelerating effect is not affected by the manner of addition thereof.

In addition to the above described bleaching agents and other additives, the bleaching bath for use in the present invention can contain a rehalogenating agent such as a bromide including potassium bromide, sodium bromide and ammonium bromide, a chloride including potassium chloride, sodium chloride and ammonium chloride, etc. Also, known additives for conventional bleaching baths, including inorganic acids, organic acids and their salts having a pH buffering ability, for example, nitrates such as sodium nitrate, ammonium nitrate, etc., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., can be added to the bleaching bath for use in the present invention.

The bleaching agent concentration in the bleaching bath for use in the present invention ranges from 0.1 to 1 mol/l, preferably from 0.2 to 0.5 mol/l.

The bleaching bath is desirably adjusted to a pH of 4.0–8.0, particularly 5.0–6.5.

On the other hand, the bleaching agent concentration in the bleach-fix (i.e., blix) bath for use in the present invention ranges from 0.05 to 0.5 mol/l, preferably from 0.1 to 0.3 mol/l.

In the bleach-fix bath for use in the present invention, thiosulfates such as sodium thiosulfate, ammonium thiosulfate, ammonium sodium thiosulfate, potassium thiosulfate, etc., thiocyanates such as sodium thiocyanate, ammonium thiocyanate, potassium thiocyanate, etc., thioureas, thioethers or the like can be used as a fixing agent. A suitable fixing agent concentration in the bleach-fixing bath ranges from 0.3 to 3 mol/l, particularly from 0.5 to 2 mol/l.

In addition to the above described bleaching and fixing agents, additives which can be contained in the bleaching bath can be also contained in the bleach-fix bath of the present invention.

The amount of the solution which overflows from the bleaching bath and is introduced into the bleach-fix bath, and the amount of the fixing agent-containing solution with which the bleach-fix bath is replenished are selected such that the bleaching agent concentration and the fixing agent concentration are maintained in the above described respective ranges. These amounts, depending on the relationship between the bleaching agent concentration in the overflow of the bleaching bath as introduced into the bleach-fix bath, and the fixing agent concentration in the replenisher for the bleach-fix bath are preferably within the range of from 50 to 900 ml per $m^2$ of photographic material processed in the bleach-fix bath.

To the fixing agent-containing solution (as opposed to the bleach-fixing solution) for use in the present invention, known fixing agents such as ammonium thiosulfate, sodium thiosulfates, etc., and all additives known to be usable for conventional fixing baths, including sulfites, hydrogen sulfites, various buffers, chelating agents and sulfinic acids, can be added. The desired concentration of each such ingredient in the fixing agent-containing solution can be established by diluting the fixing agent-containing bath with the solution overflowing from the bleaching bath. Therefore, the concentrations of all of the ingredients for the fixing agent-containing solution can initially be set higher than those in a replenisher for a conventional fixing bath. Thus, the quantity of waste solution can be reduced, and the recovery cost can be reduced.

As used herein, the fixing agent-containing solution does not contain a bleaching agent and is different from the bleach-fixing solution.

A suitable fixing agent concentration in the fixing agent-containing solution for use in the present invention ranges from 0.5 to 4 mol/l, particularly from 1 to 3 mol/l.

A suitable pH of the fixing agent-containing solution is in the range of from 6 to 10, particularly from 7 to 9. Fe(III) complex salts of aminopolycarboxylic acids, ammonium halides such as ammonium bromide, and alkali halides such as sodium bromide and sodium iodide may be further added to the fixing agent-containing solution.

The pH of the bleach-fix bath for use in the present invention is in the range of from 5 to 8, preferably from 6 to 7.5.

A processing time for bleaching and bleach fixing is from 20 seconds to 6 minutes, at a temperature of from 25° C. to 45° C.

The introduction of the solution overflowing from the bleaching bath into the bleach-fix bath may be carried out by connecting an overflow tube fitted in the bleaching tank to the bleach-fix tank directly, or by first storing the solution overflowing from the bleaching bath in a vessel, mixing therewith the fixing agent-containing solution, and then transferring the resulting mixture into the bleach-fix tank. Also, the stored solution in the vessel and the fixing agent-containing solution may be separately transferred to the bleach-fix tank. An amount of a replenisher is from 30 to 900 ml/$m^2$, preferably from 50 to 150 ml/$m^2$ photographic material.

In the present invention, a washing step may be interposed between the bleaching bath and the bleach-fix bath. Moreover, the washing step may be performed using a washing bath having a low water, for example, from 30 to 1000 cc/m$^2$ photosensitive material, replenishment rate.

After the above-described desilvering processing, washing and/or a stabilization step is generally carried out in accordance with the processing method of the present invention. However, a stabilization step may be carried out alone without a washing procedure.

The water washing bath for use in the washing step may contain known additives, as required, including, e.g., chelating agents such as inorganic phosphoric acid, aminopolycarboxylic acids, organic phosphoric acids, etc., bactericides and antimolds for preventing growth of various kinds of bacteria, weeds and molds, hardeners such as magnesium salts, aluminum salts, etc., surfactants for the reduction of drying load and occurrence of water marks and the like. Also, other compounds as described, e.g., in "Water Quality Criteria" by L. E. West, published in *Photo. Sci. and Eng.*, vol. 9, No. 6. pp. 344–359 (1965), can be added to the washing bath.

The washing step may be carried out using two or more tanks, if desired, and water may be saved by adopting a multistage (e.g., 2- to 9-stage) counter-current process.

An amount of a replenisher is from 100 to 10,000 cc/m$^2$ photosensitive material.

A stabilizing bath for use in the stabilization step performs the function of dye-image stabilization. For example, a solution having a buffer capacity which maintains the pH in the range of from 3 to 6, or a solution containing an aldehyde (e.g., formaldehyde) can be used as the stabilizing bath. To the stabilizing bath, brightening agents, chelating agents, bactericides, antimolds, hardeners, surfactants and the like can be added.

The stabilization step may be carried out using two or more tanks, if desired. Furthermore, adoption of a multistage (e.g., 2- to 9-stage) counter-current method enables savings in the quantity of stabilizing solution and, additionally, omission of the washing step. An amount of a replenisher is from 50 to 1000 cc/m$^2$ photosensitive material.

The processing times for washing step and stabilizing step are 10 seconds to 5 minutes, preferably from 30 seconds to 2 minutes, at a temperature of from 5° C. to 45° C., preferably from 10° C. to 40° C., with a solution having pH of from 3 to 8.

The washing and stabilizing treatment may be referred to JP-A-57-8543, JP-A-58-14834 and JP-A-60-220345.

In every processing bath, a heater, a temperature sensor, a liquid level sensor, a circulation pump, a filter, a floating lid, a squeezer, etc. may be installed, as needed.

In applying the processing method of the present invention, a conventional silver halide color photographic material can be used without modification. However, a silver halide color reversal photographic material is preferably used. Examples thereof include color reversal films for slide or television use, color reversal paper, etc. Among them, color reversal paper using a reflective support, or a photosensitive material for printing, wherein a positive image is formed from an original or original picture, is favored, in particular, color reversal paper is more preferable. The above-described processing steps other than the black-and-white development step may be appropriately modified to accommodate the particular constitution and/or special ingredients of a silver halide color reversal photographic material for processing in accordance with the present invention. Silver halide color photographic materials for processing in accordance with the processing method of the present invention are described in detail below.

Photographic materials for processing in accordance with the present processing method comprise a support having thereon at least three silver halide emulsion layers including at least one blue-sensitive layer, at least one green-sensitive layer and at least one red-sensitive layer. These silver halide emulsion layers and other light-insensitive layers are not particularly limited as to the number of constituent layers and order of arrangement. A silver coverage of the color photographic material according to the present invention is preferably not more than 2 g/m$^2$ photographic material, more preferably from 0.7 to 1.5 g/m$^2$, and particularly preferably from 0.8 to 1.0 g/m$^2$. The advantages of the present invention is remarkably appeared in the process for treating a silver halide photographic material containing such a low silver coverage. As a typical example, mention may be made of a silver halide photographic material having on a support at least one light-sensitive layer constituted by two or more silver halide emulsion layers having substantially the same color sensitivity but differing in photographic speed. Such a light-sensitive layer is a unit light-sensitive layer having color sensitivity to any of blue light, green light and red light. The unit light-sensitive layers in a multilayer silver halide color photographic material are generally arranged in order of a red-sensitive layer, a green-sensitive layer and a blue-sensitive layer, with the red-sensitive layer being closest to the support. However, the above order may be reversed, as needed. An arrangement order wherein a light-sensitive layer differing in color sensitivity is placed between constituent layers having the same color sensitivity may also be used.

Moreover, light-insensitive layers including various kinds of interlayers may be provided between the above described silver halide light-sensitive layers, and as the uppermost and lowermost layers of the photographic material.

The above noted interlayers may contain, e.g., couplers and DIR compounds as disclosed in JP-A-61-43748, JP-A-59-113438, JP-59-113440, JP-A-61-20037 and JP-A-61-20038, and conventionally used color stain inhibitors.

A plurality of silver halide emulsion layers which constitute each of the unit light-sensitive layers is preferably a two-layer structure consisting of a high-speed emulsion layer and a slow emulsion layer, as disclosed in West German Patent 1,121,470 or British Patent 923,045. In general, it is preferred to arrange the constituent layers of a unit light-sensitive layer such that the low photographic speed emulsion layer is closest to the support. Also, a light-insensitive layer may be sandwiched in between constituent layers of each unit light-sensitive layer. On the other hand, it is also possible to dispose a low speed emulsion layer on the side farthest from the support and to dispose a high-speed emulsion layer of the unit light-sensitive layer on the side closest to the support, as disclosed, e.g., in JP-A-57-112751, JP-A-62-200350, JP-A-62-206541 and JP-A-62-206543.

More specifically, a slow blue-sensitive layer (BL), a high-speed blue-sensitive layer (BH), a high-speed green-sensitive layer (GH), a slow green-sensitive layer (GL), a high-speed red-sensitive layer (RH) and a slow redsensitive layer (RL) can be arranged in the order where BL is farthest from the support. Also, an arrangement order of BH/BL/GL/ GH/RH/RL/Support; BH/BL/GH/GL/RL/RH/Support; etc. can be employed.

In addition, an arrangement order of Blue-sensitive layer/GH/RH/GL/RL/Support as disclosed in JP-B-55-34932, and an arrangement order of Blue-sensitive layer/GL/RL/GH/RH/Support as disclosed in JP-A-56-25738 and JP-A-62-63936 can also be employed.

As for the arrangement of three layers within a unit layer having the same color sensitivity but differing in photographic speed, as disclosed in JP-B-49-15495, it is possible to arrange these layers such that the photographic speed is decreased stepwise in the direction of the support, namely, the arrangement wherein a silver halide emulsion layer of the highest speed is provided as an upper layer, a silver halide emulsion layer having a speed lower than that of the upper layer as an intermediate layer, and a silver halide emulsion layer having a speed lower than that of the intermediate layer as the lowest layer. A unit light-sensitive layer having a three-layer structure, may be arranged in the order of a medium-speed emulsion layer farthest from the support, a high-speed emulsion layer and a low-speed emulsion layer as disclosed in JP-A-59-202464. In addition, an arrangement order of a high-speed emulsion layer/low-speed emulsion layer/medium-speed emulsion layer, or an arrangement order of a low-speed emulsion layer/-medium-speed emulsion layer/high-speed emulsion layer may be adopted. Also, when the unit light-sensitive layer is constituted by four or more constituent layers, various arrangement orders may be adopted similar to those described above.

For improving color reproducibility, a donor layer (CL) having an interimage effect which differs in distribution of spectral sensitivity from that of a main image forming light-sensitive layer such as BL, GL, RL, etc., may be arranged adjacent or near to the main light-sensitive layer which is to receive the interimage effect.

As described above, the optimal layer structure and arrangement is selected depending on the intended application of the photographic material.

The silver halide contained in the photographic emulsion layers of the photographic light-sensitive material for use in the present invention is preferably silver iodobromide, iodochloride or iodochlorobromide having an iodide content of about 30 mol % or less. Particularly preferred is silver iodobromide or iodochlorobromide having an iodide content of from about 2 mol % to about 25 mol %.

Silver halide grains in the photographic emulsions may be those having a regular crystal form, such as a cube, an octahedron, a tetradecahedron, etc., or those having an irregular crystal form, such as a sphere, a plate, etc., those having crystal imperfections, such as a twinned plane, or those having a composite form of two or more of the above-noted structures.

The effects of the present invention are pronounced when applied to a photographic material which comprises at least one silver halide emulsion layer containing a silver halide emulsion comprising silver halide fine grains having an average grain size of 0.3 μm or less, preferably from 0.3 to 0.1 μm.

The fine grain emulsion may be incorporated into any of the emulsion layers which constitute the silver halide color photographic material for processing in accordance with the present invention. However, the fine grain emulsion is preferably used as a low photographic speed emulsion when a plurality of emulsion layers having the same color sensitivity but differing in photographic speed are present in the color photographic material.

The grain size distribution of the fine grains may be narrow or broad. However, a monodisperse silver halide emulsion, which has a narrow grain size distribution, is preferred.

A monodisperse silver halide emulsion as used herein has a grain size distribution defined by the following relation:

$$S = \frac{\sqrt{\Sigma (r - r_i)^2 n_i^2}}{\Sigma n_i} \quad \frac{s}{r_m} \leqq 0.20$$

That is, when the value obtained by dividing the standard deviation of grain size distribution (S) by the average grain size ($r_m$) is below 0.20, photographic material is said to be monodisperse.

The term "average grain size" as used herein refers to the average diameter in the case of spherical grains, or the average of diameters of the circles having the same areas as the projected areas of grains in the case of cubic grains or grains having a crystal form other than a cube. That is, the average grain size $r_m$ is defined as follows:

$$r_m = \frac{\Sigma n_i r_i}{\Sigma n_i}$$

(wherein $r_i$ is a diameter of each grain, and $n_i$ is the number of grains having a diameter of $r_i$).

The grain sizes as defined above can be measured by various methods known in the art. Typical methods are described, e.g., in Loveland, "Grain Size Analysis", *A.S.T.M. symposium on microscopy,* 1955, pp. 94–122, and C. E. K. Mees & T. H. James, *The Theory of The Photographic Process,* 3rd. ed., chap. 2, Macmillan (1966). These grain sizes can be determined using projected areas of grains or by diameter approximation.

Other silver halide emulsion grains for use in the present invention may be fine grains having a grain size of about 0.2 μm or less, or coarse grains having a projected area diameter up to 10 μm. The term of a projected area used herein means is defined as those occupied with at least 50% of total area of all silver halide grains. Moreover, the emulsion may be polydisperse or monodisperse.

Silver halide photographic emulsions for use in this invention can be prepared using known methods described, e.g., in *Research Disclosure* (abbreviated as RD, hereinafter), No. 17643, pp. 22–23, entitled "1. Emulsion Preparation and Types", (Dec. 1978). In addition, monodisperse disperse emulsions as disclosed in U.S. Pat. No. 3,574,628, U.S. Pat. No. 3,655,394 and British Patent 1,413,748 are advantageously used.

Also, tabular grains having an aspect ratio of at least about 5 can be used in the present invention. Such tabular grains can be readily prepared in accordance with the methods described, e.g., in Gutoff, *Photographic Science and Engineering,* vol. 14, pp. 248–257 (1970), U.S. Pat. Nos. 4,434,226, 4,414,310, 4,433,048 and 4,439,520, British Patent 2,112,157, etc.

The crystal structure of the grains may be uniform throughout, or the interior and the surface of the grains may differ in halide composition, or the grains may have a layer structure. Furthermore, halide grains in which crystal surfaces differing in halide composition are fused together through epitaxial growth, or emulsion grains in which silver halide grains are fused together with a salt other than silver halide, such as silver thiocyanate, lead oxide or the like may be used. A mixture of grains with various crystal forms may be used.

Silver halide emulsions which have undergone physical ripening, chemical sensitization and spectral sensitization treatments are generally used in the present invention. Additives for use in these steps are described in *Research Disclosure* Nos. 17643 and 18716, and the pages on which these additives are described are summarized in the table shown below.

In addition, other known photographic additives for use in the present invention as described in the above-cited two *Research Disclosure,* publications are also set forth in the following table.

| Kind of Additive | RD 17643 | RD 18716 |
|---|---|---|
| 1. Chemical Sensitizer | p. 23 | p. 648, right column |
| 2. Sensitivity Increasing Agent | | p. 648, right column |
| 3. Spectral Sensitizer and Supersensitizing Agent | pp. 23–24 | p. 648, right column, to p. 649 649, right column |
| 4. Brightening Agent | p. 24 | |
| 5. Antifoggant and Stabilizer | pp. 24–25 | p. 649, right column |
| 6. Light Absorbent, Filter Dye, and Ultraviolet Absorbent | | pp. 25–26 p. 649, right column, and p. 650, left column |
| 7. Stain Inhibitor | p. 25, right column | p. 650, from left to right columns |
| 8. Dye Image Stabilizer | p. 25 | |
| 9. Hardener | p. 26 | p. 651, left column |
| 10. Binder | p. 26 | " |
| 11. Plasticizer and Lubricant | p. 27 | p. 650, right column |
| 12. Coating Aid and Surface Active Agent | pp. 26–27 | p. 650, right column |
| 13. Antistatic Agent | p. 27 | p. 650, right column |

In order to prevent deterioration in photographic properties due to formaldehyde gas, compound capable of reacting with and fixing formaldehyde gas as disclosed in U.S. Pat. Nos. 4,411,987 and 4,435,503 is preferably incorporated in the photographic material for processing in accordance with the present invention.

Various kinds of color couplers can be used in the photographic material for processing in accordance with the present invention also, and specific examples thereof are disclosed in the patents cited in the above cited RD 17643 (Items VII-C to VII-G).

As for yellow couplers, those disclosed, e.g., in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and EP-A-0249473 are preferred.

As for magenta couplers, 5-pyrazolone compounds and pyrazoloazole compounds are preferred. In particular, those disclosed in U.S. Pat. Nos. 4,310,619 and 4,351,807, European Patent 73,636, U.S. Pat. Nos. 3,061,432 and 3,725,067, RD 24220 (Jun. 1984), JP-A-60-33552, RD 24230 (Jun.1984), JP-A-60-43659, JP-A-61-72238, JP-A-60-35730, JP-A-55-118034, JP-A-60-185951, U.S. Pat. Nos. 4,500,630, 4,540,654 and 4,556,630, WO (PCT) 88/04795 can be used to advantage.

Preferred cyan couplers include phenol and naphthol types, as disclosed, e.g., in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-0121365, EP-A-0249453, U.S. Pat. Nos. 3,446,622, 4,333,999, 4,775,616, 4,451,559, 4,427,767, 4,690,889, 4,254,212 and 4,296,199, and JP-A-61-42658.

As for colored couplers for compensating unwanted side absorption of the formed color image, those disclosed, e.g., in RD 17643 (Item VII-G), U.S. Patent 4,163,670, JP-B-57-39413, U.S. Pat. Nos. 4,004,929 and 4,138,258, and British Patent 1,146,368 are preferred. In addition, it is desirable to use couplers capable of compensating unnecessary absorption of the formed color images by release of a fluorescent dye upon coupling reaction as disclosed in U.S. Patent 4,774,181; and couplers having as a splitting-off group a dye precursor moiety capable of forming a dye by the reaction with a color developing agent as disclosed in U.S. Patent 4,777,120.

As for the couplers which can form dyes of moderate diffusibility, those disclosed in U.S. Pat. No. 4,366,237, British Patent 2,125,570, European Patent 96,570, West German Patent Application (OLS) No. 3,234,533 are preferred.

Typical examples of polymerized couplers for use in the photographic material for processing in accordance with the present invention are disclosed, e.g., in U.S. Pat. Nos. 3,451,820, 4,080,211, 4,367,282, 4,409,320 and 4,576,910, British Patent 2,102,173, etc.

Also, couplers capable of releasing a photographically useful group in proportion to the progress of a coupling reaction can be used to advantage in the present invention. Preferred examples of couplers capable of releasing a development inhibitor, namely, DIR couplers, include those disclosed in the patents described in RD 17643 (Item VII-F), JP-A-57-151944, JP-A-57-154234, JP-A-60-184248, JP-A-63-37346, JP-A-63-37350, and U.S. Pat. No. 4,248,962 and 4,782,012.

As for the couplers capable of imagewise releasing a nucleating agent or a development accelerator upon development, those disclosed in British Patents 2,097,140 and 2,131,188, JP-A-59-157638 and JP-A-59-170840 are preferred.

Other couplers for use in the present invention include competing couplers as disclosed in U.S. Pat. No. 4,130,427; multiequivalent couplers as disclosed in U.S. Pat. Nos. 4,283,472, 4,338,393 and 4,310,618; DIR redox compound-releasing couplers, DIR coupler-releasing couplers, DIR coupler-releasing redox compounds or DIR redox compound-releasing redox compounds as disclosed in JP-A-60-185950 and JP-A-62-24252; couplers capable of releasing a dye which can recover its color after elimination as disclosed in EP-A-0173302, bleach accelerator-releasing couplers as disclosed in RD 11449, RD 24241 and JP-A-61-201247; ligand-releasing couplers as disclosed in U.S. Pat. No. 4,553,477; leuco dye-releasing couplers as disclosed in JP-A-63-75747; fluorescent dye-releasing couplers as disclosed in U.S. Pat. No. 4,774,181; etc.

Couplers for use in the present invention can be introduced into the photographic material using various known dispersion methods.

Examples of high boiling solvents for use in the oil-in-water dispersion method are described, e.g., in U.S. Pat. No. 2,322,027.

More specifically, high boiling organic solvents having a boiling point of 175° C. or higher under ordinary atmospheric pressure for use in the oil-in-water dispersion method include phthalic acid esters (e.g., dibutyl phthalate, dicyclohexyl phthalate, di-2-ethylhexyl phthalate, decyl phthalate, bis(2,4-di-t-amylphenyl)phthalate, bis-(2, 4-di-t-amylphenyl)isophthalate, bis(1,1-diethyl-propyl) phthalate), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexylbenzoate, dodecylbenzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic acid esters (e.g., bis(2-ethylhexyl) cebacate, dioctyl azelate, glycerol tributyrate, isostearyl lactate, trioctyl citrate), aniline derivatives (e.g., N,N-dibutyl-2-butoxy-5-tert-octylaniline), hydro-carbons (e.g., paraffin, dodecylbenzene, diisopropyl-naphthalene), etc. In addition, organic solvents having a boiling point of from about 30° C., preferably from about 50° C. to about 160° C. can be used as an auxiliary solvent, with typical examples including ethyl acetate, butyl acetate, ethyl propionate, methyl ethyl ketone, cyclohexanone, 2-ethoxyethyl acetate, dimethylformamide, etc.

As for the latex dispersion method, processes and effects thereof, and latexes used for impregnation are specifically described in U.S. Pat. No. 4,199,363, West German Patent Application (OLS) Nos. 2,541,274 and 2,541,230, etc.

A color photographic material for processing in accordance with the present invention preferably contains development inhibiting compound-releasing hydroquinones as disclosed in U.S. Pat. No. 3,379,529, U.S. Pat. No. 3,639,417 and JP-A-64-546, development inhibiting compound-releasing naphthoquinones as described in *Research Disclosure,* No. 18264 (Jun. 1979), and the like.

It is desirable to add to the color photographic material for processing in accordance with the present invention various kinds of antiseptics or antimold agents, e.g., 1,2-benzisothiazoline-3-one, n-butyl p-hydroxybenzoate, phenol, 4-chloro-3,5-dimethylphenol, 2-phenoxyethanol and 2-(4-thiazolyl)benzimidazole, as disclosed in JP-A-63-257747, JP-A-62-272248 and JP-A-01-80941.

Supports for use in the present invention are described, e.g., in RD 17643 (page 28), and RD 18716 (from the right column on page 647 to the left column on page 648).

The photographic material for processing in accordance with the present invention preferably has a total thickness of all of the hydrophilic colloid layers present on the side of the support having the light-sensitive emulsion layers of 28 μm or less, preferably 23 μm or less, more preferably 20 μm or less. On the other hand, the film swelling speed $T_{\frac{1}{2}}$ should be 30 seconds or less, preferably 20 seconds or less. The term "film thickness" as used herein refers to the film thickness measured after storage for 2 days under conditions of 25° C.-55% RH, and the film swelling speed $T_{\frac{1}{2}}$ can be determined by techniques known in the art. For example, the measurement can be effected by the use of a swellometer of the type described in A. Green et al., *Photgr. Sci. Eng.,* Vol. 19, No. 2, pp. 124–129, and $T_{\frac{1}{2}}$ is defined as the time required to reach one-half the saturated film thickness which is taken as 90% of the maximum swollen film thickness attained when the film is processed with a color developer at 30° C. for 3 minutes and 15 seconds.

The film swelling speed $T_{\frac{1}{2}}$ can be adjusted to the desired value by adding a hardener to gelatin used as a binder, or by changing the storage conditions after coating. Additionally, a swelling degree is preferably from 150 to 400%. The swelling degree can be calculated from the maximum swollen film thickness determined under the above-described conditions, according to the following equation;

$$\frac{(\text{maximum swollen film thickness} - \text{film thickness})}{\text{film thickness}}.$$

In accordance with the present invention, a black-and-white developing bath containing bromide in a concentration of 0.025 to 0.1 mol/l is used in the color reversal development to ensure desirable photographic properties including high maximum density for the processed silver halide color photographic material, although the mechanism by which the effect of the present invention is achieved is not well understood. In addition, when the bromide concentration is maintained in the above-described range, the variation in photographic properties due to a change in the bromide concentration of the black-and-white developing bath is reduced, to thereby ensure stable photographic processing.

However, there is a tendency for photographic speed and contrast to be lowered when using a high bromide concentration due to the development inhibiting effect of bromides. This problem can be avoided by using a silver halide color photographic material having an emulsion layer comprising silver halide grains having an average grain size of 0.3 μm or less. Particularly, the use of a fine grain emulsion offsets the development inhibiting effect of a high bromide concentration in the black-and-white developer. Moreover, the use of such a fine grain emulsion reduces the variation in photographic properties due to a change in bromide concentration.

The effects of the present invention are achieved when the bromide concentration of the black-and-white developing bath is kept within the range defined by the present invention. A change in bromide concentration due to the elution of bromides from the processed photographic material can be compensated by controlling the amount of a replenisher supplied to the black-and-white developing bath, and thereby maintain the desired bromide concentration. In the present invention, the amount of a replenisher supplied to the black-and-white developing bath can be reduced since bromides are contained therein in high concentration. The reduction in the amount of a replenisher supplied to the black-and-white developing bath results in the saving of resources, and enables reduction of the amount of overflow issued from the black-and-white developing bath. Additionally, when development is carried out with a black-and-white developing bath having an initial bromide concentration of 0.025 mol/l, the effects of the invention are obtained from the start of processing.

The present invention is illustrated below in greater detail by reference to the following Examples. However, the present invention should not be construed as being limited to these examples. Unless otherwise indicated, all parts, percents and ratios are by weight.

EXAMPLE 1

On a 220 μm-thick paper support laminated on both sides with polyethylene were coated the layers described below, from the first to the twelfth layers, in the order of the following description, to prepare a multilayer color photographic material. The polyethylene laminate on the side of the first layer contained 15 wt. % of anatase type titanium white as a white pigment and a small amount of ultramarine as a bluish dye to impart to the support surface a chromaticity of 89.0, −0.18 and −0.73 expressed in the CIE 1976 (L*, a*, b*) color difference system.

The ingredients of each constituent layer and coverages thereof expressed in g/m$^2$ were as described below. The coverage for the silver halide emulsions is given based on the silver content.

| | |
|---|---|
| First Layer (gelatin layer) | |
| Gelatin | 0.30 |
| Second Layer (antihalation layer) | |
| Black colloidal silver | 0.07 |
| Gelatin | 0.50 |
| Third Layer (slow red-sensitive layer) | |
| Silver chloroiodobromide emulsion spectrally sensitized with red sensitizing dyes (ExS-1, 2 and 3 in equal in amount used) (having a chloride content of 1 mol %, an iodide content of 4 mol %, an average grain size of 0.45 μm, a variation coefficient of 10% with respect to grain size distribution, and a cubic crystal form with an iodide core type core/shell structure) | 0.06 |
| Silver iodobromide emulsion spectrally sensitized with red sensitizing dyes (ExS-1, 2 and 3 equal in amount used) (having an iodide content of 4 mol %, an average grain size of 0.5 μm, a variation coefficient of 12% with respect to grain size distribution, and a cubic crystal form) | 0.07 |
| Gelatin | 1.00 |
| Cyan coupler (2:1 mixture of ExC-1 and 2) | 0.21 |
| Discoloration inhibitor (1:1:1 mixture of Cpd-2, 3 and 4) | 0.12 |
| Coupler dispersing medium (Cpd-6) | 0.03 |
| Coupler solvent (1:1:1 mixture of Solv-1, 2 and 3) | 0.06 |
| Development accelerator (Cpd-13) | 0.05 |
| Fourth Layer (fast red-sensitive layer) | |
| Silver iodobromide emulsion spectrally sensitized with red sensitizing dyes (ExS-1, 2 and 3 equal in amount used) (having an iodide content of 6 mol %, an average grain size of 0.80 μm, variation coefficient of 18% with respect to grain size distribution, and a tabular crystal form (aspect ratio = 8) with an iodide core type core/shell structure) | 0.14 |
| Gelatin | 1.00 |
| Cyan coupler (2:1 mixture of ExC-1 and 2) | 0.30 |
| Discoloration inhibitor (1:1:1 mixture of Cpd-2, 3 and 4) | 0.15 |
| Coupler dispersion medium (Cpd-6) | 0.03 |
| Coupler solvent (1:1:1 mixture of Solv-1, 2 and 3) | 0.10 |
| Development accelerator | 0.05 |
| Fifth Layer (interlayer) | |
| Magenta colloidal silver | 0.02 |
| Gelatin | 1.00 |
| Color stain inhibitor (1:1 mixture of Cpd-7 and 16) | 0.08 |
| Color stain inhibitor solvent (1:1 mixture of Solv-4 and 5) | 0.16 |
| Polymer latex (Cpd-8) | 0.10 |
| Sixth Layer (slow green-sensitive layer) | |
| Silver chloroiodobromide emulsion spectrally sensitized with a green sensitizing dye (ExS-4) (having a chloride content of 1 mol %, an iodide content of 2.5 mol %, an average grain size of 0.28 μm, a variation coefficient of 6% with respect to grain size distribution, and a cubic crystal form with a iodide core type core/shell structure) | 0.03 |
| Silver iodobromide emulsion spectrally sensitized with a green sensitizing dye (ExS-4) (having an iodide content of 2.5 mol %, an average grain size of 0.45 μm, a variation coefficient of 10% with respect to grain size distribution, and | 0.05 |
| Gelatin | 0.80 |
| Magenta coupler (1:1 mixture of ExM-1 and 2) | 0.10 |
| Discoloration inhibitor (Cpd-9) | 0.10 |
| Stain inhibitor (1:1 mixture of Cpd-10 and 11) | 0.01 |
| Stain inhibitor (Cpd-5) | 0.001 |
| Stain inhibitor (Cpd-12) | 0.01 |
| Coupler dispersion medium (Cpd-6) | 0.05 |
| Coupler solvent (1:1: mixture of Solv-4 and 6) | 0.15 |
| Seventh Layer (fast green-sensitive layer) | |
| Silver iodobromide emulsion spectrally sensitized with a green sensitizing dye (ExS-4) (having an iodide content of 3.5 mol %, an average grain size of 0.8 μm, a variation coefficient of 21% with respect to grain size distribution, and a tabular crystal form (aspect ratio = 9) uniform throughout in iodide distribution) | 0.10 |
| Gelatin | 0.80 |
| Magenta coupler (1:1 mixture of ExM-1 and 2) | 0.10 |
| Discoloration inhibitor (Cpd-9) | 0.10 |
| Stain inhibitor (Cpd-5) | 0.001 |
| Stain inhibitor (Cpd-12) | 0.01 |
| Coupler dispersion medium (Cpd-6) | 0.05 |
| Coupler solvent (1:1: mixture of Solv-4 and 6) | 0.15 |
| Eighth Layer (yellow filter layer) | |
| Yellow colloidal silver | 0.14 |
| Gelatin | 1.00 |
| Color stain inhibitor (Cpd-7) | 0.06 |
| Color stain inhibitor solvent (1:1 mixture of Solv-4 and 5) | 0.15 |
| Polymer latex (Cpd-8) | 0.10 |
| Ninth Layer (slow blue-sensitive layer) | |
| Silver chloroiodobromide emulsion spectrally sensitized with blue sensitizing dyes (ExS-5 and 6 equal in amount used) (having a chloride content of 2 mol %, an iodide content of 2.5 mol %, an average grain size of 0.38 μm, a variation coefficient of 8% with respect to grain size distribution, and a cubic crystal form with an iodide core type core/shell structure) | 0.07 |
| Silver iodobromide emulsion spectrally sensitized with green sensitizing dyes (ExS-5 and 6 equal in amount used) (having an iodide content of 2.5 mol %, an average grain size of 0.55 μm, a variation coefficient of 11% with respect to grain size distribution, and a cubic crystal form with an iodide core type core/shell structure) | 0.10 |
| Gelatin | 0.50 |
| Yellow coupler (1:1 mixture of | 0.20 |

-continued

| | |
|---|---|
| ExY-1 and 2) | |
| Stain inhibitor (Cpd-5) | 0.001 |
| Discoloration inhibitor (Cpd-14) | 0.10 |
| Coupler dispersion medium (Cpd-6) | 0.05 |
| Coupler solvent (Solv-2) | 0.05 |
| Tenth Layer (fast blue-sensitive layer) | |
| Silver iodobromide emulsion spectrally sensitized with blue sensitizing dyes (ExY-5 and 6 equal in amount used) (having an iodide content of 2.5 mol %, an average grain size of 14 μm, a variation coefficient of 21% with respect to grain size distribution, and a tabular crystal form (aspect ratio = 14) with a iodide core type core/shell structure) | 0.25 |
| Gelatin | 1.00 |
| Yellow coupler (1:1 mixture of ExY-1 and 2) | 0.40 |
| Stain inhibitor (Cpd-5) | 0.002 |
| Discoloration inhibitor (Cpd-14) | 0.10 |
| Coupler dispersion medium (Cpd-6) | 0.15 |
| Coupler solvent (Solv-2) | 0.10 |
| Eleventh Layer (UV absorbent-containing protective layer) | |
| Gelatin | 1.50 |

-continued

| | |
|---|---|
| Ultraviolet absorbent (1:1 mixture of Cpd-7 and 6) | 1.00 |
| Dispersion medium (Cpd-6) | 0.05 |
| Ultraviolet absorbent solvent (1:1 mixture of Solv-1 and 2) | 0.15 |
| Irradiation preventing dye (1:1:1:1 mixture of Cpd-17, 18, 19 and 20) | |
| Twelfth Layer (protective layer) | |
| Gelatin | 0.90 |
| Gelatin hardener (1:1 mixture of H-1 and H-2) | 0.17 |

In addition, each constituent layer contained Alkanol XC (products of DuPont) and sodium alkylbenzensulfonate as emulsifying dispersion assistants, and a succinic acid ester and Magefac F120 (products of DaiNippon Nippon Ink & chemicals, Inc.) as coating aids. In each layer containing silver halide or colloidal silver, Cpd-23, 24 and 25 were used as stabilizers.

The thus obtained photographic material was designated Sample 101.

The compounds used in this example are illustrated below.

ExS-1

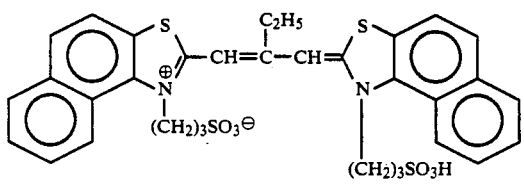

ExS-2

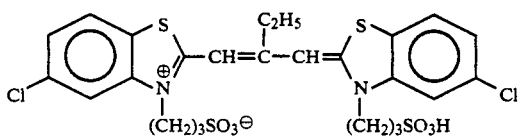

ExS-3

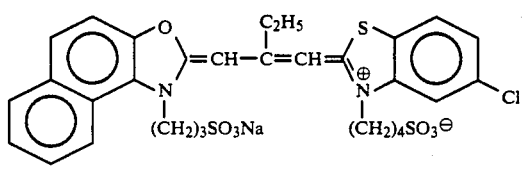

ExS-4

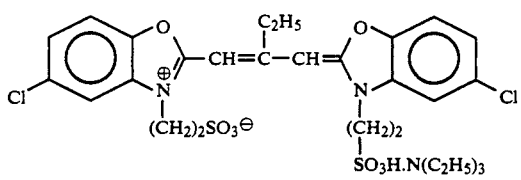

ExS-5

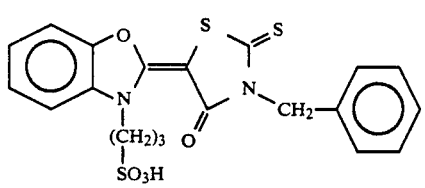

ExS-6

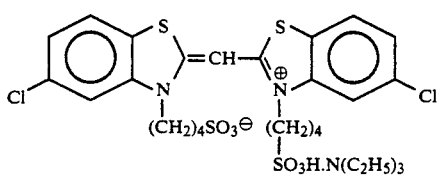

-continued
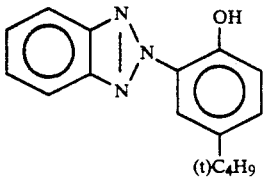
Cpd-1
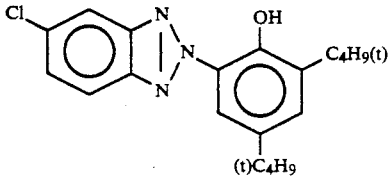
Cpd-2
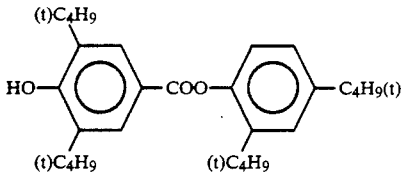
Cpd-3
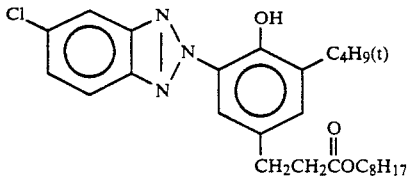
Cpd-4
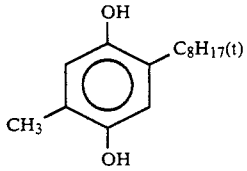
Cpd-5
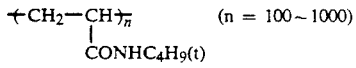
Cpd-6
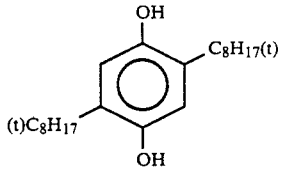
Cpd-7
Polyethylacrylate
(MW = 10,000–100,000)
Cpd-8
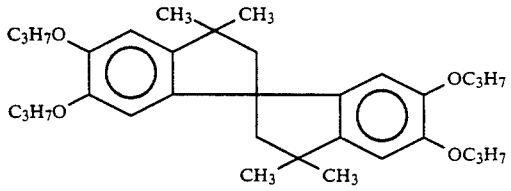
Cpd-8

-continued
Cpd-10
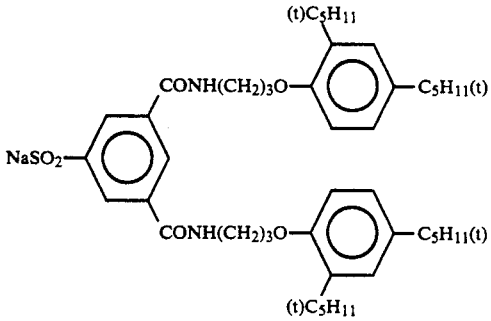
Cpd-11
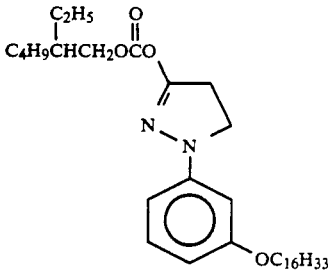
Cpd-12
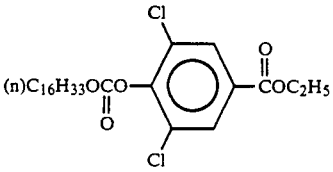
Cpd-13
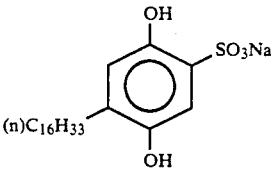
Cpd-14
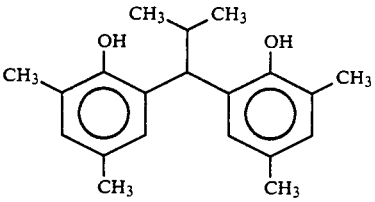
Cpd-15
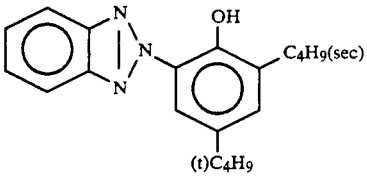
Cpd-16
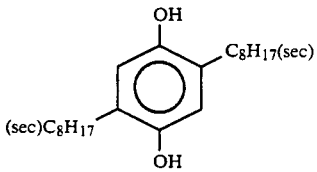

-continued
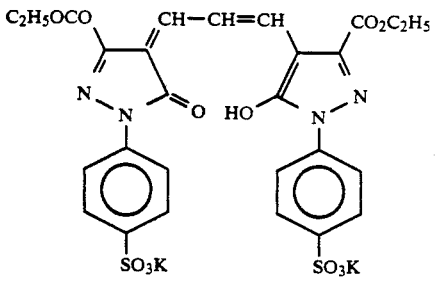
Cpd-17
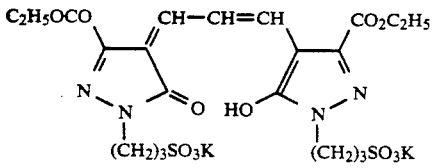
Cpd-18
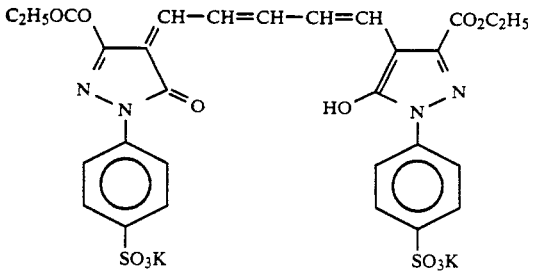
Cpd-19
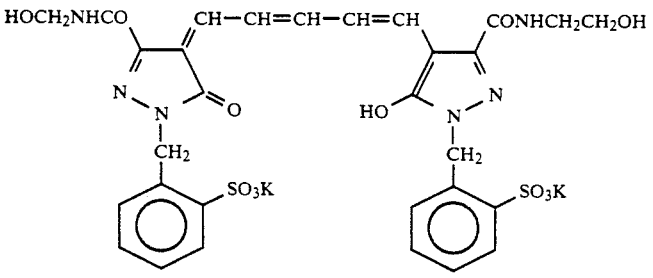
Cpd-20
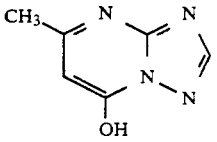
Cpd-21
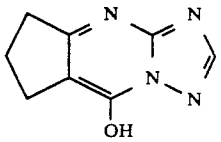
Cpd-22
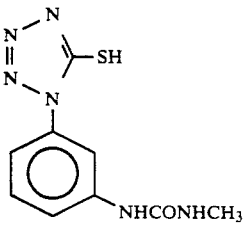
Cpd-23

-continued
ExC-1
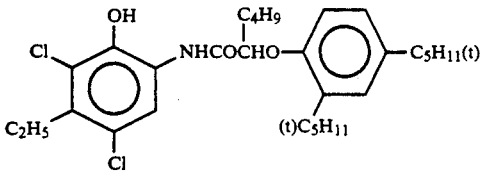
ExC-2
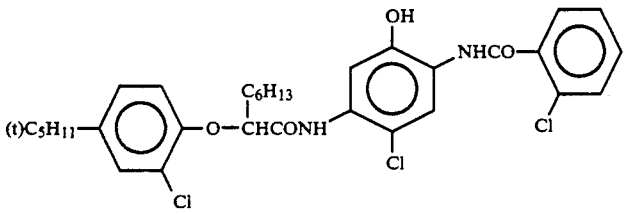
ExM-1
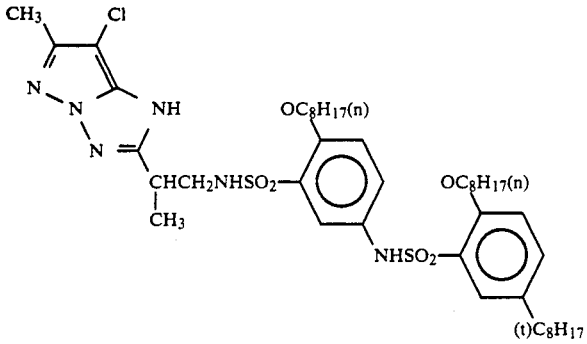
ExM-2
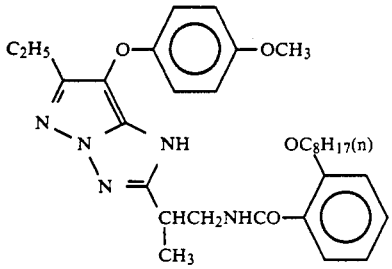
ExY-1
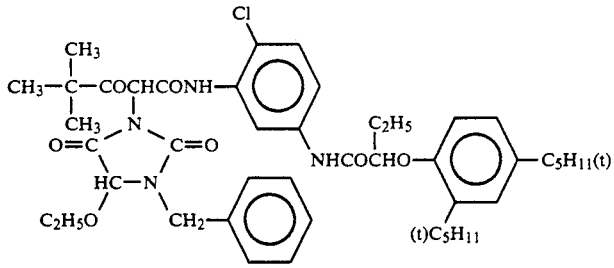
ExY-2
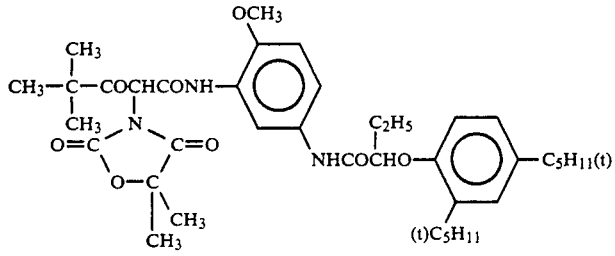
Solv-1 Di(2-ethylhexyl) phthalate
Solv-2 Trinonyl phosphate
Solv-3 Di(3-methylhexyl) phthalate
Solv-4 Tricresyl phosphate
Solv-5 Dibutyl phthalate
Solv-6 Trioctyl phosphate H-1 1,2-Bis(vinylsulfonylacetamido)ethane H-2 Sodium salt of 4,6-dichloro-2-hydroxy-1,3,5-triazine After one second imagewise exposure at 200 lux using continuous wedge with a light source of 3200° K, the thus prepared silver halide color photographic material (Sample 101) was subjected to a continuous photographic processing by the use of an automatic developing machine under the conditions described below until the accumulated amount of each replenisher reached three times the volume of the processing tank used. In carrying out the photographic processing, black-and-white developers from A to G which were different from one another in potassium bromide content were prepared, and each was evaluated in the black-and-white developing step. The bromide concentration for each black-and-white developing bath as set forth in Table 1 is the value determined at the conclusion of processing.

| Processing Step | Time | Temperature | Tank Volume | Amount Replenished |
|---|---|---|---|---|
| Black-and-white development | 75 sec. | 38° C. | 9 l | 330 ml/m$^2$ |
| First washing (1) | 45 sec. | 33° C. | 5 l | — |
| First washing (2) | 45 sec. | 33° C. | 5 l | 5000 ml/m$^2$ |
| Reversal exposure | 15 sec. | (100 lux) | | |
| Color development | 135 sec. | 38° C. | 15 l | 330 ml/m$^2$ |
| Second washing | 45 sec. | 33° C. | 5 l | 1000 ml/m$^2$ |
| Bleach-fix (1) | 60 sec. | 38° C. | 7 l | — |
| Bleach-fix (2) | 60 sec. | 38° C. | 7 l | 220 ml/m$^2$ |
| Third washing (1) | 45 sec. | 33° C. | 5 l | — |
| Third washing (2) | 45 sec. | 33° C. | 5 l | — |
| Third washing (3) | 45 sec. | 33° C. | 5 l | 320 ml/m$^2$ |
| Drying | 45 sec. | 75° C. | | |

The first and the third washing steps were carried out according to a counter current process. Namely, in the first washing step, the second washing bath (2) was replenished with water, and the water overflowing the second washing bath (2) was introduced into the first washing bath (1), while in the third washing step, the third washing bath (3) was replenished with water, the water overflowing the third washing bath (3) was introduced into the second washing bath (2), and the water overflowing the second washing bath (2) was introduced into the first washing bath (1).

the composition of each processing solution used is described below.

| Black-and-white Developer: | Tank Solution | Replenisher |
|---|---|---|
| Pentasodium nitrilo-N,N,N-trimethylenephosphonate | 1.0 g | 1.0 g |
| Pentasodium diethylenetriamine-pentaacetic acid | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-Phenyl-4-hydroxymethyl-4-methyl-3-pyrazolidone | 2.0 g | 2.0 g |
| Potassium bromide | See Tabel 1 | — |
| Potassium iodide | 5.0 mg | — |

-continued

| Black-and-white Developer: | Tank Solution | Replenisher |
|---|---|---|
| Water to make | 1,000 ml | 1,000 ml |
| pH | 9.60 | 9.70 |

The pH was adjusted with hydrochloric acid or potassium hydroxide.

| Color Developer: | Tank solution | Replenisher |
|---|---|---|
| Benzyl alcohol | 15.0 ml | 18.0 ml |
| Diethylene glycol | 12.0 ml | 14.0 ml |
| 3,6-Dithia-1,8-octanediol | 0.20 g | 0.25 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 2.0 g | 2.5 g |
| Hydroxylamine sulfate | 3.0 g | 3.6 g |
| N-ethyl-N-(β-methanesulfonamidoethyl)-3-methyl-aminoaniline sulfate | 5.0 g | 8.0 g |
| Brightening agent (diaminostilbene type) | 1.0 g | 1.2 g |
| Potassium bromide | 0.5 g | — |
| Potassium iodide | 1.0 mg | — |
| Water to make | 1000 ml | 1000 ml |
| pH | 10.15 | 10.40 |

The pH was adjusted with hydrochloric acid or potassium hydroxide.

| Bleach-Fix Bath (Tank solution = Replenisher): | |
|---|---|
| Disodium ethylenediaminetetraacetate dihydrate | 4.0 g |
| Ammonium ethylenediaminetetraacetato ferrate(III) monohydrate | 80.0 g |
| Sodium sulfite | 15.0 g |
| Ammonium thiosulfate (700 g/l) | 160 ml |
| 2-Mercapto-1,3,4 triazole | 0.5 g |
| Water to make | 1000 ml |
| pH | 6.50 |

The pH was adjusted with acetic acid or aqueous ammonia.

Samples selected at the conclusion of the above-described continuous color reversal processing were evaluated for their photographic properties, including densities of the developed cyan, magenta and yellow color images to obtain a characteristic curve as shown in FIG. 1. Using this characteristic curve, gamma was defined as follows: A tangent line was drawn at the density point corresponding to Dmin+(Dmax−Dmin)/3 on the characteristic curve, wherein Dmax represents the maximum density of a developed color image and Dmin represents the minimum density thereof, a plus-minus sign of the gradient of that tangent line was reversed, and the thus obtained value was defined as gamma. Accordingly, the gamma indicates the degree of gradation. On the other hand, the sensitivity was defined by the reciprocal of the exposure required for achieving the prescribed developed-color density (D=0.5). The results of this evaluation are shown in Table 1.

TABLE 1

| Black-and-White Developing Bath | Bromide Concentration (mol/l) | Maximum Developed-Color Density (Dmax) | | | Specific Sensitivity at D = 0.5 | | | Gradation (gamma) | | |
|---|---|---|---|---|---|---|---|---|---|---|
| | | Cyan Image | Magenta Image | Yellow Image | Cyan Image | Magenta Image | Yellow Image | Cyan Image | Magenta Image | Yellow Image |
| A (comparison) | 0.005 | 2.15 | 2.20 | 2.18 | 100 | 100 | 100 | 1.45 | 1.40 | 1.40 |
| B (comparison) | 0.010 | 2.21 | 2.25 | 2.23 | 100 | 100 | 100 | 1.42 | 1.38 | 1.36 |
| C (invention) | 0.025 | 2.57 | 2.58 | 2.50 | 100 | 100 | 100 | 1.40 | 1.35 | 1.35 |
| D (invention) | 0.040 | 2.60 | 2.63 | 2.56 | 98 | 99 | 99 | 1.40 | 1.34 | 1.35 |
| E (invention) | 0.060 | 2.61 | 2.64 | 2.58 | 96 | 98 | 98 | 1.38 | 1.33 | 1.33 |
| F (invention) | 0.080 | 2.61 | 2.65 | 2.58 | 94 | 95 | 96 | 1.35 | 1.31 | 1.30 |
| G (comparison) | 0.120 | 2.62 | 2.65 | 2.58 | 75 | 80 | 82 | 1.21 | 1.18 | 1.20 |

As seen from Table 1, the black-and-white developing baths A and B, having a low bromide concentration, exhibited a low Dmax. Although Dmax increased with an increase in bromide concentration, a bromide concentration that was too high (as in the comparative developing bath G) was undesirable due to the large reduction in sensitivity and gamma.

Since the bromide concentration in the black-and-white developing bath used in the color reversal process can be changed by controlling the amount and composition of a replenisher fed to the bath, the replenishment amount of the black-and-white developing bath can be reduced as long as the development is carried out within the bromide concentration range defined by the present invention. The processing method of the present invention desirably also saves resources and reduces environmental pollution.

EXAMPLE 2

Samples 201 to 205 were prepared in the same manner as Sample 101 in Example 1, except that the size of the silver halide emulsion grains used in the sixth layer (slow green-sensitive layer) was changed to those set forth in Table 2, respectively, and subjected to the same photographic processing as in Example 1. The resulting samples were evaluated for density of the developed magenta color image. These measurements were also used to determine the specific sensitivity and the gamma value. The results obtained are shown in Table 2.

TABLE 2

| Sample No. | Size of Emulsion Grains used in Slow green-Sensitive Layer | Specific Sensitivity at D = 0.5 Black-and-White Developing Bath | | | | | | | Gradation (gamma) Black-and-White Developing Bath | | | | | | |
|---|---|---|---|---|---|---|---|---|---|---|---|---|---|---|---|
| | | A | B | C | D | E | F | G | A | B | C | D | E | F | G |
| 201* | 0.40 μm | 100 | 97 | 93 | 87 | 82 | 75 | 60 | 1.49 | 1.35 | 1.30 | 1.26 | 1.20 | 1.15 | 1.08 |
| 202* | 0.35 μm | 100 | 98 | 95 | 90 | 86 | 78 | 65 | 1.45 | 1.36 | 1.30 | 1.28 | 1.23 | 1.18 | 1.10 |
| 203 | 0.30 μm | 100 | 100 | 99 | 97 | 96 | 93 | 78 | 1.41 | 1.37 | 1.37 | 1.36 | 1.35 | 1.31 | 1.20 |
| 204 | 0.28 μm | 100 | 100 | 100 | 99 | 98 | 95 | 80 | 1.40 | 1.38 | 1.35 | 1.34 | 1.33 | 1.31 | 1.18 |
| 205 | 0.25 μm | 100 | 100 | 100 | 99 | 99 | 97 | 85 | 1.38 | 1.38 | 1.37 | 1.37 | 1.36 | 1.35 | 1.20 |

*Comparative samples

As seen from Table 2, both sensitivity and gamma were markedly reduced when the emulsion grains were comparatively large in size. On the other hand, the use of small-size emulsion grains having a grain size of 0.3 μm or less in accordance with a preferred embodiment of this invention effectively prevented further reduction in sensitivity and gamma due to processing with the black-and-white developing bath having a relatively high bromide concentration.

The above-noted results demonstrates that the use of small-size emulsion grains can reduce change in photographic properties and promote stable photographic performance even when the bromide concentration in the black-and-white developing bath is varied.

Also, when small-size emulsion grains having a size of 0.3 μm or less were used in the third layer (slow red-sensitive layer), good results similar to those described above were obtained.

As described above, a black-and-white developing bath containing bromide in a concentration ranging from 0.025 to 0.1 mol/l is used in the present invention to increase maximum densities of the developed color images, and to thereby improve photographic properties. Furthermore, the control of the bromide concentration according to the present invention reduces the variation in photographic properties with a change in bromide concentration of the black-and-white developing bath to ensure stable photographic performance.

Furthermore, although there is a tendency for the sensitivity and the contrast to be lowered when the bromide concentration in the black-and-white developing bath is set on the high side of the present range, the processing of a silver halide color photographic material comprising a silver halide emulsion layer comprising silver halide emulsion grains having a grain size of 0.3 μm or less in accordance with a preferred embodiment of the present invention provides increased maximum densities of the developed color images without lowering of sensitivity and contrast.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color photographic material comprising a reflective support having thereon at least one red-sensitive silver halide emulsion layer, at least one blue-sensitive silver halide emulsion layer and at least one green-sensitive silver halide emulsion layer, comprising the steps of first developing for 30 seconds to 2 minutes in a black-and-white developing bath containing bromide ion in an concentration of from 0.025 to 0.1 mol/l, next color developing in a color developing bath, and then desilvering in a bath having a bleaching ability, wherein the color photographic material is a color reversal paper having a total silver coverage of not more than 2 $g/m^2$.

2. The method as in claim 1, further comprising fogging the silver halide emulsion layers of the photographic material following developing in a black-and-white developing bath and prior to color developing.

3. The method as in claim 1, further comprising fixing in a fixing bath following desilvering in the bath having a bleaching ability.

4. The method as in claim 1, wherein the bath having a bleaching ability further comprises a fixing agent.

5. The method as in claim 1, wherein the black-and-white developing bath contains bromide ion in a concentration of from 0.03 to 0.08 mol/l.

6. The method as in claim 1, wherein at least one of the silver halide emulsion layers comprise a silver halide emulsion containing silver halide fine grains having an average grain size of 0.3 μm or less.

7. The method as in claim 1, wherein a replenisher is added to the black-and-white developing bath in an amount of from 30 to 500 ml per $m^2$ of the photographic material processed.

8. The method as in claim 1, wherein said processing is carried out continuously.

9. The method as in claim 1, wherein the silver halide constituting the silver halide emulsion layers is silver iodobromide or silver iodochlorobromide having an iodide content of from 2 mol % to about 25 mol %.

10. The method as in claim 2, wherein said processing constitutes color reversal processing.

11. The method as in claim 1, wherein the color reversal paper has a total silver coverage of from 0.7 to 1.5 $g/m^2$.

* * * * *